US005490491A

United States Patent [19]

Troncoso

[11] Patent Number: 5,490,491

[45] Date of Patent: Feb. 13, 1996

[54] ARCHERY ARROW REST ASSEMBLY WITH ADJUSTABLE ANGLE AND TENSION CAPABILITY

[75] Inventor: Vincent F. Troncoso, Montrose, Colo.

[73] Assignee: Golden Key Futura, Inc., Montrose, Colo.

[21] Appl. No.: 370,091

[22] Filed: Jan. 9, 1995

[51] Int. Cl.[6] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 4,236,497 | 12/1980 | Troncoso | 124/24.1 |
| 4,476,846 | 10/1984 | Carville | 124/44.5 |
| 4,686,956 | 8/1987 | Troncoso | 124/44.5 |
| 4,748,964 | 6/1988 | Troncoso | 124/44.5 |
| 4,827,895 | 5/1989 | Troncoso | 124/44.5 |
| 4,838,237 | 6/1989 | Cliburn | 124/44.5 |
| 5,070,855 | 12/1991 | Troncoso | 124/44.5 |
| 5,117,803 | 6/1992 | Johnson | 124/44.5 |
| 5,137,006 | 8/1992 | Gallops | 124/44.5 |
| 5,383,441 | 1/1995 | Lightcap | 124/44.5 |

*Primary Examiner*—John A. Ricci
*Attorney, Agent, or Firm*—Donald E. Nist

[57] ABSTRACT

The improved archery arrow rest assembly includes an arrow shaft support, the rear end of which is releasably secured to the free end of a cylindrical cross-bar which in turn is disposed for rotation in an elongated barrel bearing longitudinal grooves. The barrel is releasably clamped to the rear end of an elongated mounting block, the front end of which is adapted to be secured to the sidewall of an archery bow in the riser section thereof. The sidewall defines an arrow window into which the arrow shaft support projects. The barrel and cross-bar extend transversely through the block behind the archery bow to a point remote from the window, that is, on the side of the bow opposite the window. A click blade engages the barrel through the block to provide incrmental rotation of the barrel and thus angled adjustment of the arrow shaft support. A cup is received over the end of the cross-bar opposite from its free end. A coiled spring is releasably disposed around the cross-bar and connected to the cup and barrel, so that rotation of the cup adjusts the rotational spring tension on the cross-bar and support when the cup is locked to the cross-bar by a screw or the like. Thus, the angle and tension on the depressible arrow shaft support are easily adjusted, as well as the position of the support in the window.

5 Claims, 1 Drawing Sheet

ARCHERY ARROW REST ASSEMBLY WITH ADJUSTABLE ANGLE AND TENSION CAPABILITY

BACKGROUND OF THE INVENTION

1. Field of the Invention

The present invention generally relates to sports equipment and more particularly to an improved archery arrow rest which provides adjustable angle and tension capability for the shaft-supporting portion of the rest.

2. Prior Art

Various types of arrow rests have been used in archery bows. The rests usually are mounted on the sidewall of the bow in the arrow window defined by the sidewall in the riser section of the bow. Certain of the rests are simple devices pasted or screwed to the window sidewall, while others are suspended in the window away from the sidewall in order to provide the desired arrow clearance, that is, to assure that the arrow when shot from the bow will not strike the sidewall and fly off the desired line of flight.

One preferred manner of suspending the arrow in the window away from the sidewall is to connect the rear end of the blade portion of the arrow rest on which the arrow shaft rests to a cross-bar which extends transversely behind the window and which, in turn, is slideably received in the rear end of a forwardly and rearwardly extending mounting block secured to the sidewall. With this arrangement, the blade portion of the rest can be adjustably spaced a desired distance from the sidewall.

However, it is also desired for optimal flight of the arrow from the bow that the arrow rest provide means for resisting the downward thrust exerted by the arrow as it is shot from the bow. For this purpose, resilient blades of metal, plastic or the like have been used. In other instances, stiff blades connected to coiled springs pinned to non-moving components of the rest have been used.

While such arrangements may be satisfactory for a fixed set of conditions, that is, a single type of bow using a single type of arrow, they are of little use when the propulsion force of the bow is changed, as is possible with compound bows, and/or the arrow is changed in diameter, flexibility, etc., as may be necessary for optimum arrow flight. Conventional arrow rests do not provide the capability of freely and easily adjusting the resistance of the arrow blade to downward deflection, particularly in a simple, inexpensive manner which is devoid of disadvantages.

Moreover, it is also desireable to be able to easily control the angle at which the rest blade projects upwardly into the window. The optimum angle of projection will depend on many factors and will change from arrow type to arrow type, etc. Hunting arrows with heavy bradheads, for example, usually require a different angle of projection than do lighter, faster arrows used for target archery.

It would be highly desireable to be able to change the angle of projection of the rest blade in a manner which is recordable and reproducible, so that as the archer switches from one type of archery use to another, the optimum angle of projection can always be set for the rest blade. Presently available archery arrow rests do not provide such a capability.

SUMMARY OF THE INVENTION

The improved arrow rest assembly of the present invention satisfies all the foregoing needs. Thus, the present arrow rest assembly is fully and easily adjustable in a reproducible way with respect to the resistance of the arrow shaft-support portion of the rest to downward deflection by the arrow when it is shot from the rest. The rest is also fully adjustible in a reproducible way with respect to the angle of inclination of the arrow shaft-support portion of the rest as it projects into the arrow window. These two features, as well as others detailed hereinafter, render the improved rest assembly of the present invention unique and highly advantageous.

The assembly is substantially as set forth in the ABSTRACT OF THE DISCLOSURE. Thus, the assembly comprises an arrow shaft support, preferably in the form of a pair of forwardly and upwardly projecting laterally spaced arms or blades which support or cradle the underside of the arrow shaft in the shooting position. The rear end of the support is releasably connected to the free end of a transverse cylindrical crossbar, the central portion of which is received for rotation in an elongated barrel whose outer surface bears longitudinal striations or grooves.

The cross-bar is held behind the riser portion of an archery bow by having the barrel releasably clamped to the rear end of a forwardly and rearwardly extending mounting block, the front end of which is releasably connectable to the sidewall of the bow riser in the area defining the arrow window.

A clicker blade passes through the mounting block into contact with the barrel grooves, so that when the barrel is loosened in the block, it can be rotated and the clicks counted in order to be able, when desired, to rotate the barrel back to its original position. Rotation of the barrel causes the angle of inclination of the arrow support blade to change, that is, the angle of projection of the blade up and into the window, in order to adapt the rest to an optimum angle for a given type of arrow, etc.

The barrel and the opposite end of the cross-bar from that which holds the blade extend transversely through the block to a point remote from the window, that is, on the side of the sidewall opposite to that which defines the window, and the barrel and cross-bar at that point are releasably connected to means for adjustably tensioning the resistance of the blade to downward deflection by the arrow shaft during shooting of the arrow.

Such adjustable tensioning means comprise an end cup which fits over the cross-bar end towards the end of the barrel, and a spring disposed over the cross-bar end in the cup and releasably connected to the barrel and and cup. When the cup is rotated around the cross-bar end, the spring is twisted and rotational tension on the cup is changed to any desired degree. That tension is then held in place by screwing the cup tightly to the cross-bar, transferring the rotational spring tension from the cup to the cross-bar. The extent of such tension can thereby be controlled and can be reproduced, as desired, by noting the position of the cup relative to a fixed point, such as adjacent top of the mounting block or the set screw therein.

The assembly also includes a stop bar projecting from the cross-bar and received within a slot in the barrel, to limit the rotational movement of the cross-bar relative to the barrel.

The assembly is simple, durable, inexpensive and reliable, with the spring fully enclosed within the cup for maximum protection. The components of the assembly are easy to adjust, assemble and disassemble, as needed. Further features of the improved arrow rest assembly of the present invention are set forth in the following detailed description and accompanying drawings.

DRAWINGS

DETAILED DESCRIPTION

Figure 1:
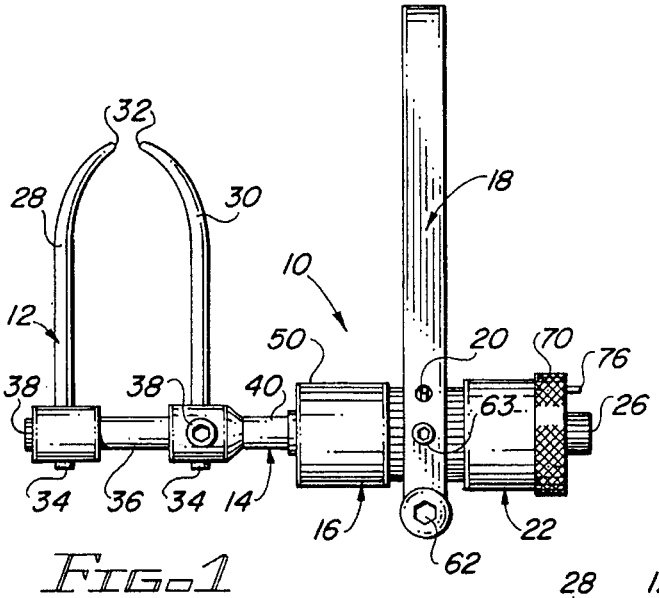
FIG. 1 is a schematic top plan view of a preferred embodiment of the improved archery arrow rest assembly of the present invention.

FIGS. 1–5.

Now referring more particularly to FIGS. 1–5 of the drawings, a preferred embodiment of the improved archery bow arrow rest assembly of the present invention is schematically depicted therein.

Thus, assembly 10 is shown which comprises, in combination, an archery arrow shaft support 12, a transverse cross-bar 14 connected to support 12, a barrel 16 disposed around cross-bar 14, a mounting block 18 releasably securing barrel 16 and cross-bar 14, a click blade 20 intercepting barrel 16 through block 18, a cup 22 slideably received over cross-bar 14, a coiled spring 24 in cup 22 secured to cup 22 and barrel 16 and a lock screw 26 locking cup 22 to cross-bar 14.

Assembly 10 exhibits the capability of adjusting the angle of support 12 in an archery bow window and of adjustably tensioning support 12 against downwardly urging force applied against support 12 by an arrow shaft when shot from support 12.

Support 12 may be in any suitable form, preferably comprising, as shown in FIG. 1, a laterally spaced pair of arms 28 and 30, the front ends 32 of which curve toward each other and are adapted to support or cradle the underside of an archery arrow shaft for shooting from support 12. The rear ends 34 of arms 28 and 30 pass through openings (not shown) in the free end 36 of cross-bar 14 and are releasably secured therein, as by screws 38.

The central portion 40 of cross-bar 14 is received for rotation in barrel 16 and bears a depending limit arm 42 which extends out through a slot 44 in the underside of barrel 16 to limit the extent of that rotation and to prevent cross-bar 14 from being retracted from barrel 16. The end 46 of cross-bar 14 opposite free end 36 extends with barrel 16 to the side 48 of block 18 which is remote from support 12.

Barrel 16 is elongated and cylindrical, as is cross-bar 14, and the outer surface of barrel 16 has a plurality of evenly spaced striations or grooves 50 running the length thereof. Mounting block 18 is preferably rectangular in side elevation, with a front end portion 52 bearing a series of three interconnected transverse holes 54 to facilitate mounting of block 18 against the sidewall (not shown) of an archery bow riser in the area defining the arrow window in the bow.

Preferably, block 18 is mounted, as by screws through holes 54, on the side of the sidewall which is away from the arrow window. Block 18 is adapted to extend rearwardly of the bow riser, and rear end 56 of block 18 has a cylindrical hole 58 therein through which barrel 16 and cross-bar 14 are received, as shown in FIG. 1. Rear end 56 is split into upper and lower spaced arms 60 to form a clamp, and a vertical screw 62 extends down through arms 60 to releasably clamp barrel 16. Screw 63 also releasably clamps barrel 16 to block 18.

Figure 3:
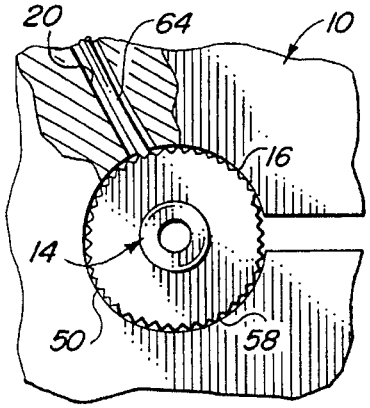
FIG. 3 is an enlarged schematic fragmentary left side elevation, partly broken away, of the barrel and clicker array of the assembly of FIG. 1.
Figure 2:
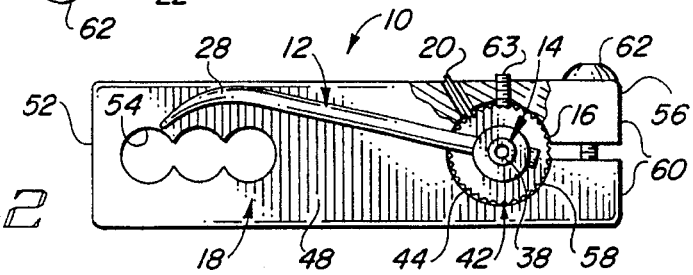
FIG. 2 is a schematic left side elevation, partly broken away, of the assembly of FIG. 1.
Figure 4:
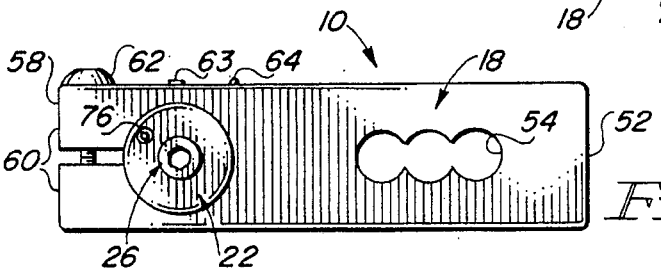
FIG. 4 is a schematic right side elevation of the assembly of FIG. 1.
Figure 5:
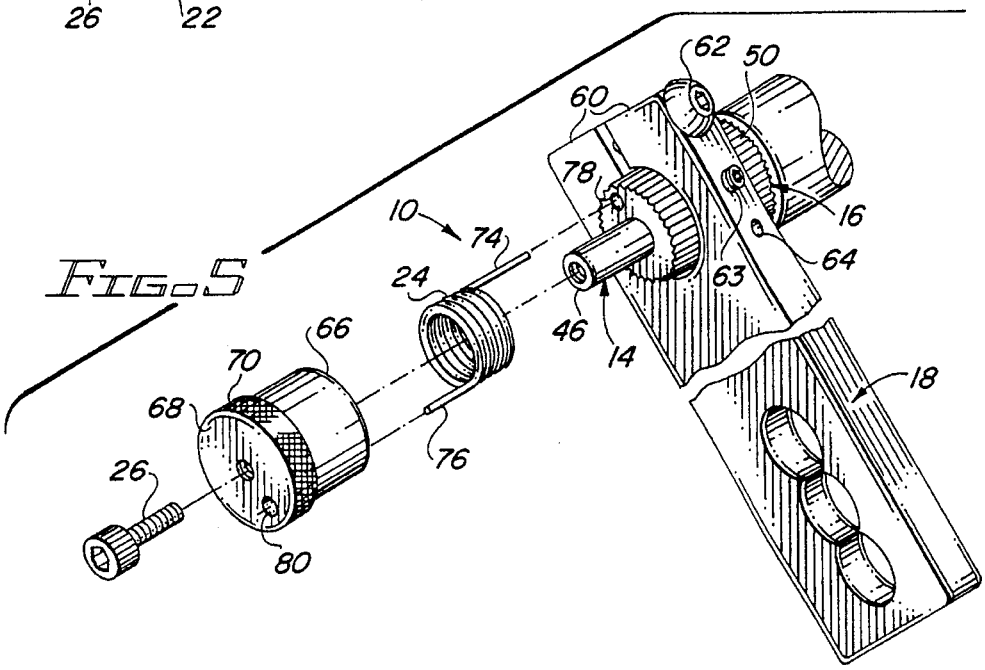
FIG. 5 is a schematic, exploded, right side perspective view of the assembly of FIG. 1, showing the components thereof which provide the adjustable spring tensioning of the arrow shaft support of the assembly.

Block 18 bears blade 20 in passage 64. Blade 20, as shown in FIGS. 2 and 3, intercepts grooves 50 of barrel 16, so that when barrel 16 is loosened in hole 58 and rotated, blade 20 makes audible clicks which can be counted in order to restore, if desired, barrel 16 to its unrotated position. Rotation of barrel 16 can thus be controlled to adjustably position the angle of inclination or projection of support 12 into the arrow window for optimal launching of an arrow from support 12.

Cup 22 is cylindrical and hollow, with an open end 66 and an opposite closed end 68 bearing an external raised knurled turn-ring 70. It will be noted from FIG. 5 that end 46 of cross-bar 14 projects laterally beyond barrel 16 and is threaded to receive lock screw 26 which passes through a central opening 74 in cup 22. Spring 24 is coiled and has arms 74 and 76 projecting from opposite ends thereof. Spring 24 fits around end 46 of cross-bar 14 with arm 74 releasably received in opening 78 in the adjacent end of barrel 16 and with arm 76 releasably received in opening 80 in end 68 of cup 22.

When it is desired to tension support 12 to resist downward depression thereof by an arrow during shooting of the arrow from support 12, cup 22 is rotated in the desired direction with spring 24 connected to barrel 16 and cup 22, whereupon the spring tensioning is locked in place by tightly screwing screw 26 against cup end 68, forcing it into tight engagement with end 46 of cross-bar 14. The rotational tensioning is thus transferred to cross-bar 14, causing it and support 12 to resist downward rotation of support 12 to a desired extent.

The extent of rotation of cup 22 before locking it in place can be noted, so that the same or different amount of spring tension can be applied to cross-bar 14 at a later time. Accordingly, such tensioning is fully repeatable and adjustable.

Assembly 10 can be fabricated of any suitable materials. Preferably, support 12 is of stainless steel or the like, while cross-arm 14, barrel 16, block 18 and cup 22 can be of the same or other material, such as anodized aluminum or the like.

Assembly 10 can be made inexpensively and is durable and efficient as previously described. It can be made in any desired size and can be utilized on both left-handed and right-handed archery bows. Arms 28 and 30 can be substituted for by wires, plastic or metal triangular support pieces or the like, if desired.

Various other modifications, changes, alterations and additions can be made in the improved assembly of the present invention, its components and parameters. All such modifications, changes, alterations and additions as are within the scope of the present claims form part of the present invention.

PRIOR ART STATEMENT

A search of the prior art has not been made. The closest prior art known to Applicant are the U.S. patents listed and discussed below, one copy of each of which is enclosed herewith:

4,236,497 4,748,964 4,827,895 5,070,855

Although each of the above-listed patents discloses an archery bow arrow rest which comprises an arrow shaft support projecting forwardly and upwardly into the window of an archery bow and spaced laterally of the sidewall of the bow, none of the above-listed patents discloses the present claimed arrow rest. Moreover, none of the cited arrow rests have the components and advantages of the present claimed rest.

U.S. Pat. No. 4,236,497 discloses a rest which employs a pair of coiled springs which act as arrow shaft supports. The springs are non-adjustable with respect to tension to resist depression of the support during shooting an arrow from the rest. In contrast, the present claimed rest provides fully adjustable spring tension for the shaft support.

U.S. Pat. No. 4,748,964 also fails to provides adjustable spring tension against depression of the rest, but relies on the inherent resilience of the material employed for the support, which is non-adjustable.

U.S. Pat. No. 4,827,895 relies on coiled spring 44 for its non-adjustable tension, which could only be changed by changing spring 44. Moreover, spring 44 is exposed to the elements and to easy breakage, in contrast to the concealed fully adjustable spring of the present claimed invention.

U.S. Pat. No. 5,070,855 also depends on fully exposed spring 48 subject to the same deficencies as spring 44 of U.S. Pat. No. 4,827,895. Moreover, the arrow rest of U.S. Pat. No. 5,070,855 is complicated, has numerous exposed parts such as bar 38 which is likely to be hooked on the archer's equipment.

None of the four listed patents employ a barrel around the cross-bar, which barrel extends with the cross-bar through the locking block and moves transversely therewith, fully containing the cross-bar and making the present claimed arrow rest simple to adjust for tension on the support and for angle positioning of the support.

In view of the above, it is believed that the present claimed invention is clearly patentable over these patents and all other prior art known to Applicant.

What is claimed is:

1. An improved archery arrow rest assembly with adjustable angle and tension capability, said arrow rest assembly comprising, in combination:

a) an archery arrow shaft support having a front end adapted to support an arrow shaft and an opposite rear end;

b) a transverse cross-bar having a free end, an intermediate portion and an opposite end, said free end being releasably connected to the rear end of said support, for projecting said support forwardly into the window of an archery arrow bow, said cross-bar being generally circular in transverse cross-section;

c) an elongated cylindrical barrel receiving said intermediate portion of said cross-bar for rotation within said barrel, the outer periphery of said barrel being striated with regularly spaced longitudinally extending grooves, said barrel having a first end adjacent said free end of said cross-bar and an opposite end adjacent said opposite end of said cross-bar;

d) a forwardly and rearwardly extending elongated mounting block having a front end and an opposite rear end, said front end of said block being adapted to be secured to the sidewall of the riser section of an archery bow, which sidewall defines said window on one side thereof, and said rear end being adapted to extend rearwardly of said riser section to a position therebehind, said rear end of said block slideably receiving said barrel bearing said transverse cross-bar, said opposite end of said barrel and transverse cross-bar extending therethrough to a point on the side of said sidewall remote from said window;

e) locking means releasably locking said barrel to said rear end of said block in a desired transverse position;

f) a click blade extending through said rear end of said block into releasable contact with said peripheral grooves of said barrel, thereby providing incremental rotation of said barrel and cross-bar for selective adjustment of the angle of said arrow shaft support;

g) a cup slideably received over said opposite end of said cross-bar for rotation therearound; and, h) a spring releasably connected to said opposite end of said barrel and to said cup, and a lock releasably locking said cup to said cross-bar and barrel, said spring applying rotational spring bias to said cross-bar and support, which bias is adjustable by rotation of said cup before locking said cup to said cross-bar.

2. The improved assembly of claim 1 wherein said spring is a coil spring having two opposite arms, one of which is releasably received in a groove in said opposite end of said barrel and the other of said arms being releasably received in an opening in said cup.

3. The improved assembly of claim 2 wherein said lock releasably securing said cup to said barrel and cross-bar is a screw threaded into said opposite end of said cross-bar and extending through an opening in said cup to tightly secure said cup to said cross-bar.

4. The improved assembly of claim 3 wherein said rear end of said block is split into two arms to form a clamp and wherein a threaded screw passes through said block arms to releasably clamp said barrel to said block.

5. The improved assembly of claim 4 wherein said arrow shaft support comprises a pair of laterally spaced arms which converge toward each other at the front end of said support to cradle an arrow shaft at the front end of said support.

* * * * *